US007926552B2

(12) United States Patent
Metcalf et al.

(10) Patent No.: US 7,926,552 B2
(45) Date of Patent: Apr. 19, 2011

(54) JACKET FOR HEAT DISPERSION DEVICE

(75) Inventors: Jeffrey Metcalf, Frisco, TX (US); Brandon Rubenstein, Loveland, CO (US); Stephen D. Cromwell, Penryn, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 761 days.

(21) Appl. No.: 11/875,218

(22) Filed: Oct. 19, 2007

(65) Prior Publication Data

US 2009/0101317 A1 Apr. 23, 2009

(51) Int. Cl.
*F28D 15/00* (2006.01)

(52) U.S. Cl. ..... 165/80.3; 165/104.26

(58) Field of Classification Search ..... 165/80.3, 165/104.19, 104.21, 104.26, 104.33
See application file for complete search history.

(56) References Cited

U.S. PATENT DOCUMENTS

| | | | | |
|---|---|---|---|---|
| 3,844,342 | A * | 10/1974 | Eninger et al. | 165/104.26 |
| 6,507,488 | B1 | 1/2003 | Cipolla et al. | |
| 6,563,703 | B2 | 5/2003 | Xie | |
| 7,455,102 | B2 * | 11/2008 | Cheng | 165/104.33 |
| 2006/0118277 | A1 * | 6/2006 | Connors et al. | 165/104.26 |

FOREIGN PATENT DOCUMENTS

| | | |
|---|---|---|
| JP | 5719591 | * 2/1982 |
| JP | 62245087 | * 10/1987 |

* cited by examiner

*Primary Examiner* — Teresa J Walberg

(57) ABSTRACT

An apparatus comprising a heat dispersion device having a first end. The first end has a shape different than that of the remainder of the heat dispersion device. The apparatus also comprises a jacket coupled to the heat dispersion device at the first end. The jacket has another shape associated with that of the remainder of the heat dispersion device.

20 Claims, 2 Drawing Sheets

JACKET FOR HEAT DISPERSION DEVICE

BACKGROUND

Many electronic devices contain one or more heat pipes. A heat pipe cools an electronic device by collecting heat from one area and distributing that heat over a comparatively larger area. Typical heat pipe fabrication processes cause heat pipes to be fabricated with at least part of each heat pipe being unusable for cooling purposes. In particular, during a typical fabrication process, a first end of a cylindrical heat pipe is closed and a second end is left open. The heat pipe is filled with porous material and deionized water through the second end. The second end is then sealed. The manner in which the second end is sealed (e.g., crimping or soldering) generally precludes the second end from being used for cooling purposes. This preclusion wastes valuable real estate inside the electronic device that contains such a heat pipe.

BRIEF DESCRIPTION OF THE DRAWINGS

For a detailed description of exemplary embodiments of the invention, reference will now be made to the accompanying drawings in which.

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect, direct, optical or wireless electrical connection. Thus, if a first device couples to a second device, that connection may be through a direct electrical connection, through an indirect electrical connection via other devices and connections, through an optical electrical connection, or through a wireless electrical connection.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
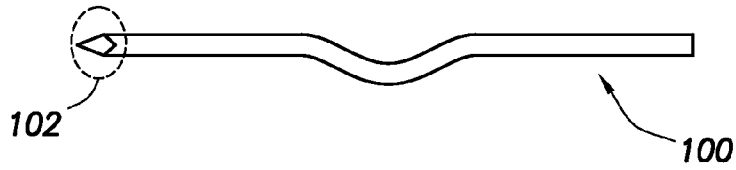
FIG. 1 shows an illustrative heat pipe having a crimped end, in accordance with various embodiments.

Disclosed herein are various embodiments of a technique by which a heat dispersion device (e.g., a heat pipe) is adapted to increase the rate at which the device disperses heat. FIG. 1 shows an illustrative heat dispersion device 100. The device 100 comprises a generally cylindrical shape. The device 100 may be of any suitable size, depending on the system in which the device 100 is to be implemented. In some embodiments, the diameter of the device 100 ranges from 5 mm to 30 mm. The device 100 may comprise any suitable, heat-conducting material.

During the fabrication process, the heat dispersion device 100 is filled with material that aids the device 100 in dispersing heat. For example, the device 100 may be filled with porous material and deionized water. In at least some embodiments, the device 100 has two ends, one of which is open and one of which is closed. The device 100 is filled with material (e.g., the porous material and deionized water) through the open end. Once the device 100 has been at least partially filled, the open end is at least partially sealed by any suitable process, such as crimping or soldering. Indicator 102 of FIG. 1 references such a crimped end. The end 102 may be as shown (e.g., a conical shape) or may have any other shape that renders the end 202 unsuitable for heat dispersion purposes, as described below.

In many applications, heat dispersion devices are installed in heat sinks. Fins, which aid in the dispersion of heat, are then coupled to the heat dispersion devices. Unfortunately, due to its shape, a crimped or soldered end is unable to support fins. For example, fins may slide off of a crimped end that has a tapered shape different from that of the rest of the device 100, as referenced by indicator 102 of FIG. 1. Accordingly, FIG. 2*a* shows an illustrative jacket 200 that may be coupled to the heat dispersion device 100, thereby providing sufficient support for fins such that the fins do not slide off of the device 100.

Figure 2A:
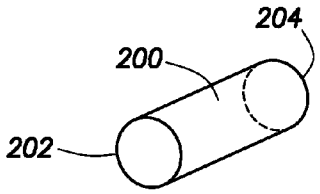
FIGS. 2*a* and 2*b* show different views of a jacket that may be coupled to the heat pipe of FIG. 1, in accordance with various embodiments.
Figure 2B:
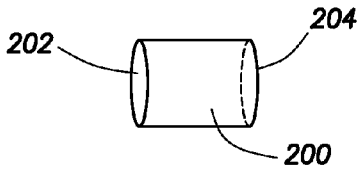

Still referring to FIG. 2*a*, the jacket 200 may comprise any suitable material, such as copper. The jacket 200 may be hollow and may have a shape (e.g., a cylindrical shape) and size that are substantially similar to those of at least portions of the device 100. In some embodiments, the jacket 200 has a cross-sectional area that is substantially similar to those of at least some portions of the device 100. In some embodiments, the jacket 200 is associated with a length that is approximately the same as the length of the crimped end referenced by indicator 102 in FIG. 1. In some embodiments, the jacket 200 has a diameter that is within approximately two millimeters of a diameter associated with portions of the device 100 other than the crimped end 102. The jacket 200 comprises an end 202 and another end 204. In at least some embodiments, the end 202 is solid (i.e., closed) and the end 204 is open. FIG. 2*b* provides an alternate view of the jacket 200.

Figure 3A:
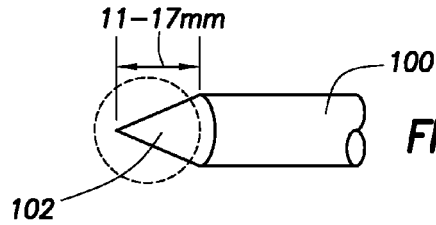
FIGS. 3*a*-3*c* show the coupling of the jacket in FIGS. 2*a*-2*b* to the heat pipe of FIG. 1, in accordance with various embodiments.
Figure 3B:
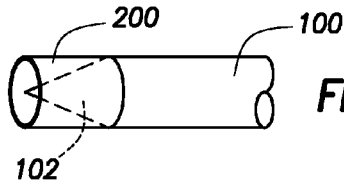
Figure 3C:
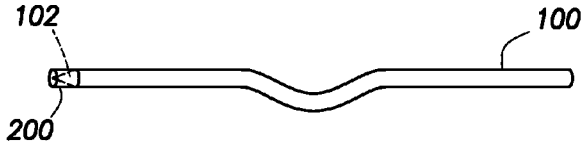

The jacket 200 may couple to the device 100 as shown in FIGS. 3*a*-3*c*. Referring to FIG. 3*a*, the crimped end 102 of device 100 is shown in detail. In at least some embodiments, the crimped end 102 ranges in length from approximately 11 mm to 17 mm. FIG. 3*b* shows the jacket 200 coupled to the device 100. As shown, in some embodiments, the jacket 200 has a length that is approximately the same as that of the crimped end 102. In other embodiments, the jacket 200 may have a length that is less than that of the crimped end 102. The jacket 200 may couple to the device 100 using any suitable technique, such as soldering or swaging techniques. FIG. 3*c* shows the entire device 100 with the crimped end 102 coupled to the jacket 200.

Figure 4A:
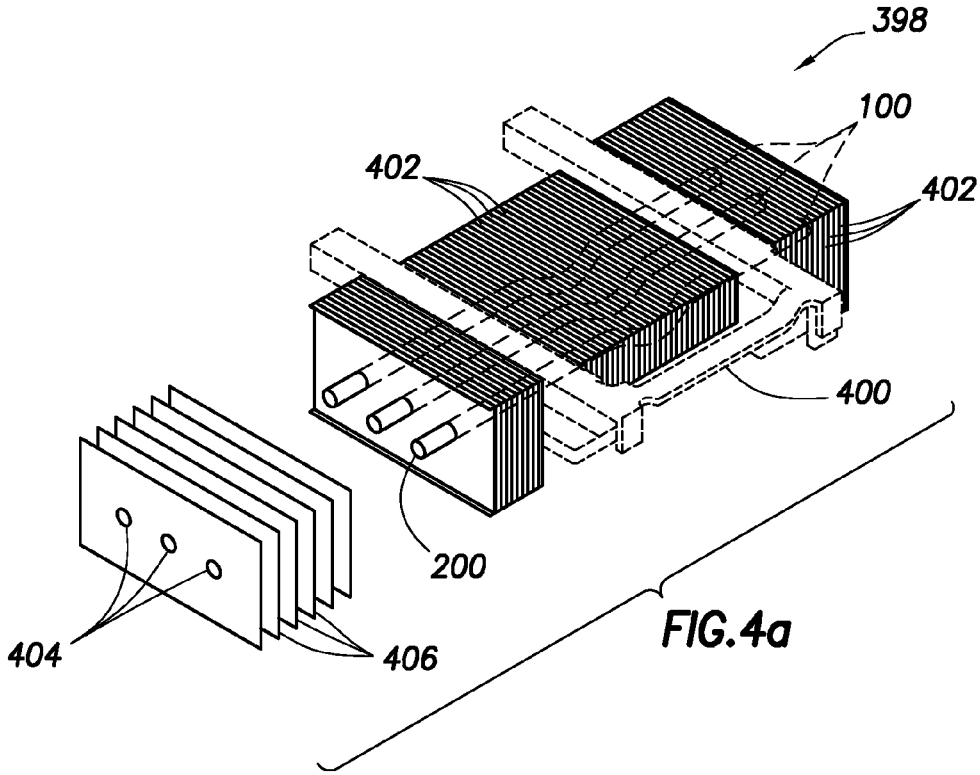
FIGS. 4*a*-4*b* show a heat sink containing multiple heat pipes having jacket and fins mounted on the heat pipes, in accordance with various embodiments.
Figure 4B:
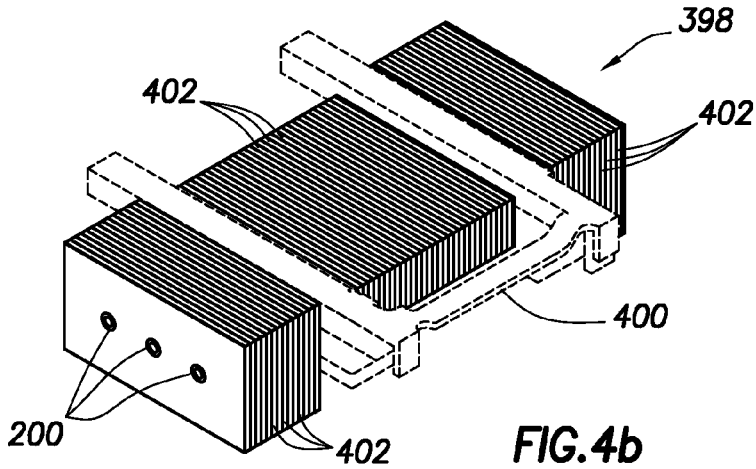

FIG. 4*a* shows a heat sink 398 comprising multiple heat dispersion devices 100. Specifically, the heat sink 398 comprises a frame 400 that mechanically supports multiple devices 100. In turn, the heat dispersion devices 100 mechanically support multiple fins 402, which aid the heat dispersion devices 100 in dissipating heat. Each heat dispersion device 100 couples to a different jacket 200, as shown. Inside each jacket 200 is a sealed (e.g., crimped, soldered) end of a corresponding device 100. Due to its shape, without the jacket 200, the sealed end would not be able to support as many fins 402 as it would be able to with the jacket 200. Accordingly, as shown in FIG. 4*a*, coupling the jackets 200 to the devices 100 enables additional fins 406 having orifices 404 to be slid onto and supported by the devices 100. In particular, the devices 100 (and associated jackets 200) slide through the orifices 404, thereby supporting the fins 406. A heat sink 398 comprising heat dispersion devices 100 that are fully loaded with fins 402 is shown in FIG. 4*b*. In this way, a jacket 200 increases the number of heat-dissipating fins that can be supported by a device 100. The jacket 200 dissipates heat to the fins so supported. Therefore, although the amount of real estate occupied by the crimped end with the jacket 200 is generally similar to that occupied by the crimped end without the jacket 200, the jacket 200 enables the heat dispersion device 100 to dissipate additional heat.

Figure 5:
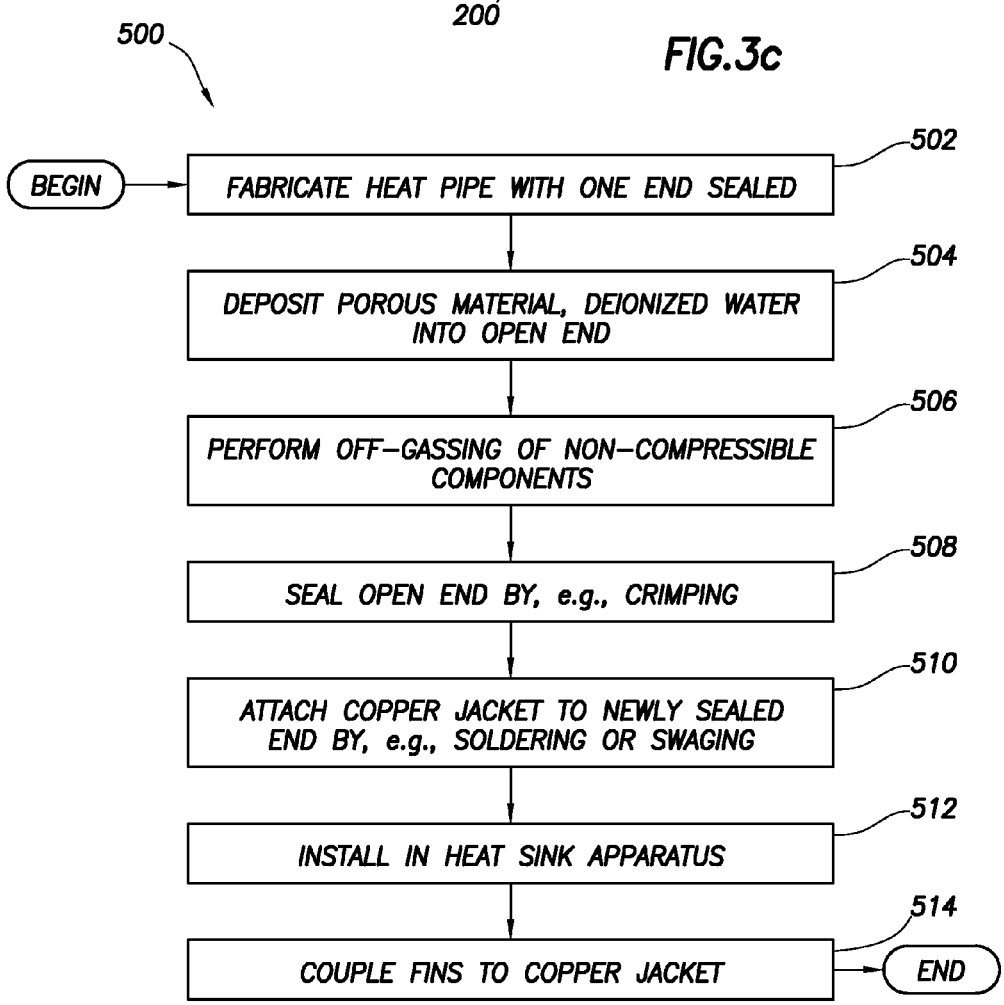
FIG. 5 shows a flow diagram of an illustrative method implemented in accordance with various embodiments.

FIG. 5 shows a flow diagram of an illustrative method 500 implemented in accordance with various embodiments. The method 500 begins by fabricating a heat dispersion component, such as a heat pipe, with one end sealed and the other end open (block 502). The method 500 also comprises depositing porous material and deionized water into the device via the open end (block 504). The method 500 then comprises performing off-gassing of non-compressible components (block 506). The method 500 further comprises at least partially sealing the open end using any suitable technique, such as crimping (block 508). The method 500 still further comprises coupling a copper jacket to the at-least-partially sealed end using any suitable technique, such as soldering or swaging (block 510). The method 500 yet further comprises installing the heat dispersion component in a heat sink apparatus (block 512). The method 500 then comprises coupling fins to the copper jacket (block 514). Not all embodiments require the various portions of the method 500 to be performed in the precise order described above. The various portions of the method 500 may be performed in any suitable order, as desired.

The heat sink as shown in FIGS. 4*a*-4*b* may be used in any suitable electronic or mechanical application. Such heat sinks may be implemented in personal computers, mobile devices, etc. For example, a computer implementing the heat sink as shown in FIGS. 4*a*-4*b* may comprise processing logic, storage/memory, etc., as well as a chassis containing the heat sink and heat dispersion devices coupled thereto. The heat sink and heat dispersion devices may collect heat from one or more locations within the computer and may expel the heat from the computer via any suitable means (e.g., using a fan).

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An apparatus, comprising:

a heat dispersion device having a first end, the first end having a cross-sectional area different than that of another portion of the heat dispersion device; and a jacket that receives the first end of the heat dispersion device, the jacket having another cross-sectional area associated with that of said another portion of the heat dispersion device;

wherein both the heat dispersion device and the jacket support heat-dispersing fins.

2. The apparatus of claim 1, wherein the apparatus comprises an electronic device.

3. The apparatus of claim 1, wherein the jacket comprises a copper jacket.

4. The apparatus of claim 1, wherein the first end is crimped.

5. The apparatus of claim 1, wherein the apparatus comprises a heat sink and the heat dispersion device comprises a heat pipe.

6. The apparatus of claim 5, wherein the heat sink mechanically supports the heat dispersion device, and wherein the heat dispersion device mechanically supports at least one fin, and wherein said fin disperses heat from the heat dispersion device.

7. The apparatus of claim 1, wherein a diameter associated with the jacket is within 2 millimeters of another diameter associated with said another portion of the heat dispersion device.

8. The apparatus of claim 1, wherein said jacket is coupled to the heat dispersion device using a soldering technique or a swaging technique.

9. The apparatus of claim 1, wherein the heat dispersion device comprises porous material and deionized water.

10. The apparatus of claim 1, wherein said another cross-sectional area is greater than said cross-sectional area.

11. A heat sink, comprising:

a heat dispersion device adapted to couple to a jacket;

a frame adapted to support the heat dispersion device; and fins, supported by the heat dispersion device, that disperse heat from the heat dispersion device;

wherein the heat dispersion device is able to support a greater number of fins when the heat dispersion device is coupled to the jacket than when the heat dispersion device is not coupled to the jacket.

12. The heat sink of claim 11, wherein the heat dispersion device, when not coupled to the jacket, has a length; and wherein the heat dispersion device, when coupled to the jacket, also has said length.

13. The heat sink of claim 11, wherein the jacket comprises copper.

14. The heat sink of claim 11, wherein the jacket is coupled to the heat dispersion device using either a soldering technique or a swaging technique.

15. The heat sink of claim 11, wherein, when the jacket is coupled to the heat dispersion device, a portion of the heat dispersion device is housed inside the jacket.

16. A method, comprising:

fabricating a heat dispersion device, said heat dispersion device having a first, open end;

at least partially sealing the first end such that the first end has a shape different from that of another portion of the heat dispersion device; and coupling a jacket to the first, at-least-partially-sealed end, the jacket having another shape associated with that of said another portion of the heat dispersion device.

17. The method of claim 16 further comprising filling said heat dispersion device with at least one of a porous material and deionized water via said first end.

18. The method of claim 16, wherein at least partially sealing the first end comprises crimping or soldering the first end.

19. The method of claim 16 further comprising inserting said heat dispersion device into a heat sink and coupling one or more fins to said heat dispersion device.

20. The method of claim 16, wherein coupling the jacket to the heat dispersion device comprises soldering or swaging the jacket to the heat dispersion device.

* * * * *